US010228176B2

(12) United States Patent
Mitchell et al.

(10) Patent No.: US 10,228,176 B2
(45) Date of Patent: Mar. 12, 2019

(54) ICE MAKER WITH A THREADED CONNECTION BETWEEN A MOTOR SHAFT AND AN AUGER

(71) Applicant: General Electric Company, Schenectady, NY (US)

(72) Inventors: Alan Joseph Mitchell, Louisville, KY (US); Bart Andrew Nuss, Fisherville, KY (US); Ansuraj Seenivasan, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 18 days.

(21) Appl. No.: 15/045,432

(22) Filed: Feb. 17, 2016

(65) Prior Publication Data

US 2017/0234594 A1 Aug. 17, 2017

(51) Int. Cl.

| | |
|---|---|
| ***F25C 1/147*** | (2018.01) |
| *F25D 23/06* | (2006.01) |
| *F25D 17/06* | (2006.01) |
| *F25C 5/02* | (2006.01) |
| *F25C 5/185* | (2018.01) |
| *F25C 5/04* | (2006.01) |
| *F25C 5/182* | (2018.01) |
| *F25D 23/02* | (2006.01) |
| *F25C 5/18* | (2018.01) |

(52) U.S. Cl.

CPC ..... *F25C 1/147* (2013.01); *F25C 5/02* (2013.01); *F25C 5/04* (2013.01); *F25C 5/046* (2013.01); *F25C 5/18* (2013.01); *F25C 5/182* (2013.01); *F25C 5/185* (2013.01); *F25C 2700/10* (2013.01); *F25D 17/065* (2013.01); *F25D 23/028* (2013.01); *F25D 23/065* (2013.01)

(58) Field of Classification Search

CPC .. F25C 5/046; F25C 5/04; F25C 5/005; F25C 5/02; F25C 5/18; F25C 5/182; F25C 5/185; F25C 2700/10; F25D 23/065; F25D 17/065; F25D 23/028

USPC ..... 62/344

See application file for complete search history.

(56) References Cited

U.S. PATENT DOCUMENTS

| | | | | |
|---|---|---|---|---|
| 3,064,442 | A * | 11/1962 | Bougic | F25C 1/04 62/135 |
| 3,175,369 | A | 3/1965 | Murphy et al. | |
| 3,214,935 | A | 11/1965 | Conto | |
| 3,230,737 | A * | 1/1966 | Lunde | F25C 1/147 62/354 |
| 3,371,505 | A * | 3/1968 | Raver | F25C 1/147 62/320 |

(Continued)

FOREIGN PATENT DOCUMENTS

WO WO2010001997 A1 1/2010

*Primary Examiner* — Frantz F Jules
*Assistant Examiner* — Lionel Nouketcha
(74) *Attorney, Agent, or Firm* — Dority & Manning, P.A.

(57) ABSTRACT

An ice maker includes a casing that defines a chamber. The casing extends between a top portion and a bottom portion. An extruder die is mounted to the casing at the top portion of the casing. A motor is positioned above the extruder die. An auger is disposed within the chamber of the casing. The auger is coupled to a shaft of the motor with a threaded connection such that the auger is rotatable with the motor along a rotational direction within the chamber of the casing. The threaded connection between the auger and the shaft of the motor is wound opposite the rotational direction of the auger. A related refrigerator appliance is also provided.

14 Claims, 8 Drawing Sheets

(56) References Cited

U.S. PATENT DOCUMENTS 3,727,293 A * 4/1973 Phillips, Sr. ..... B25B 27/023 29/264
3,860,182 A * 1/1975 Peterson ..... B02C 18/144 241/101.78
4,250,718 A * 2/1981 Brantley ..... F25C 1/147 277/500
4,361,081 A * 11/1982 Howard ..... B29C 47/38 100/117
4,741,173 A * 5/1988 Neumann ..... F25C 1/147 62/298
5,056,688 A * 10/1991 Goetz ..... F25C 5/005 222/146.6
5,123,260 A 6/1992 Althoff et al.
5,189,891 A * 3/1993 Sakamoto ..... F25C 1/147 100/117
5,325,679 A * 7/1994 Tatematsu ..... F25C 1/147 62/188
5,644,927 A 7/1997 Tatematsu et al.
5,823,744 A * 10/1998 Rockwood ..... F04D 29/20 416/204 R
6,301,908 B1 * 10/2001 Huffman ..... F25C 1/147 62/137
6,343,416 B1 * 2/2002 Miller ..... F25C 1/147 29/890.035
6,715,925 B2 * 4/2004 Pairone ..... D06F 37/00 384/255
2003/0000240 A1 * 1/2003 Pahl ..... A23G 9/045 62/389
2004/0079104 A1 * 4/2004 Antognoni ..... F25C 1/147 62/354
2005/0193759 A1 * 9/2005 Brunner ..... F25C 1/145 62/354
2007/0204643 A1 * 9/2007 Harris ..... F25C 5/005 62/340
2008/0098765 A1 * 5/2008 Bond ..... A23G 9/045 62/342
2009/0101670 A1 * 4/2009 Restive ..... A01M 7/0017 222/1
2011/0049190 A1 * 3/2011 Sevcik ..... F25C 5/002 222/236
2013/0183426 A1 * 7/2013 Ledger ..... A47J 43/042 426/519
2013/0276472 A1 * 10/2013 Mitchell ..... F25C 1/147 62/344
2015/0128633 A1 * 5/2015 Mitchell ..... F25C 1/147 62/344

* cited by examiner

ICE MAKER WITH A THREADED CONNECTION BETWEEN A MOTOR SHAFT AND AN AUGER

FIELD OF THE INVENTION

The present subject matter relates generally to auger-style ice makers.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Rotating the auger within the mold body poses certain challenges. For example, the auger can apply a large force onto a wall of mold body when the auger rotates and scrapes ice off the inner surface of the mold body. In turn, a bearing can be subjected to significant wear due to the large force applied by the auger, and the wear can generate debris that contaminates ice within the mold body.

Accordingly, an ice maker with features for limiting a force appliance by an auger onto a mold body during rotation of the auger within the mold body would be useful.

BRIEF DESCRIPTION OF THE INVENTION

The present subject matter provides an ice maker. The ice maker includes a casing that defines a chamber. The casing extends between a top portion and a bottom portion. An extruder die is mounted to the casing at the top portion of the casing. A motor is positioned above the extruder die. An auger is disposed within the chamber of the casing. The auger is coupled to a shaft of the motor with a threaded connection such that the auger is rotatable with the motor along a rotational direction within the chamber of the casing. The threaded connection between the auger and the shaft of the motor is wound opposite the rotational direction of the auger. A related refrigerator appliance is also provided. Additional aspects and advantages of the invention will be set forth in part in the following description, or may be apparent from the description, or may be learned through practice of the invention.

In a first exemplary embodiment, an ice maker includes a casing that defines a chamber. The casing extends between a top portion and a bottom portion. An extruder die is mounted to the casing at the top portion of the casing. A motor is positioned above the extruder die, and an auger is disposed within the chamber of the casing. The auger is coupled to a shaft of the motor with a threaded connection such that the auger is rotatable with the motor along a rotational direction within the chamber of the casing. The threaded connection between the auger and the shaft of the motor wound opposite the rotational direction of the auger.

In a second exemplary embodiment, a refrigerator appliance is provided. The refrigerator appliance includes a housing that defines a chilled chamber. An ice maker is disposed within the housing. The ice maker includes a casing that defines a chamber. The casing extends between a top portion and a bottom portion. An extruder die is mounted to the casing at the top portion of the casing. A motor is positioned above the extruder die. An auger is disposed within the chamber of the casing. The auger is coupled to a shaft of the motor with a threaded connection such that the auger is rotatable with the motor along a rotational direction within the chamber of the casing. The threaded connection between the auger and the shaft of the motor is wound opposite the rotational direction of the auger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
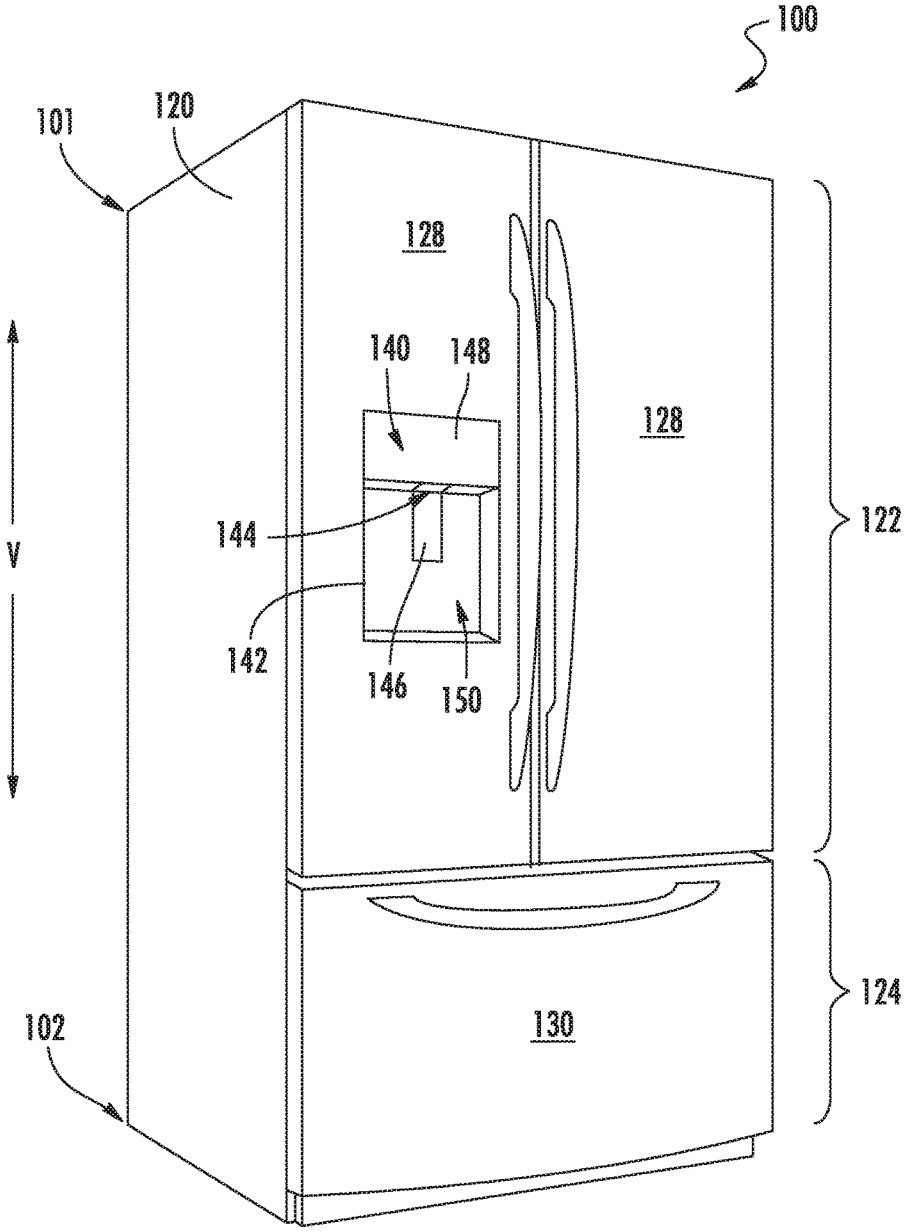
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
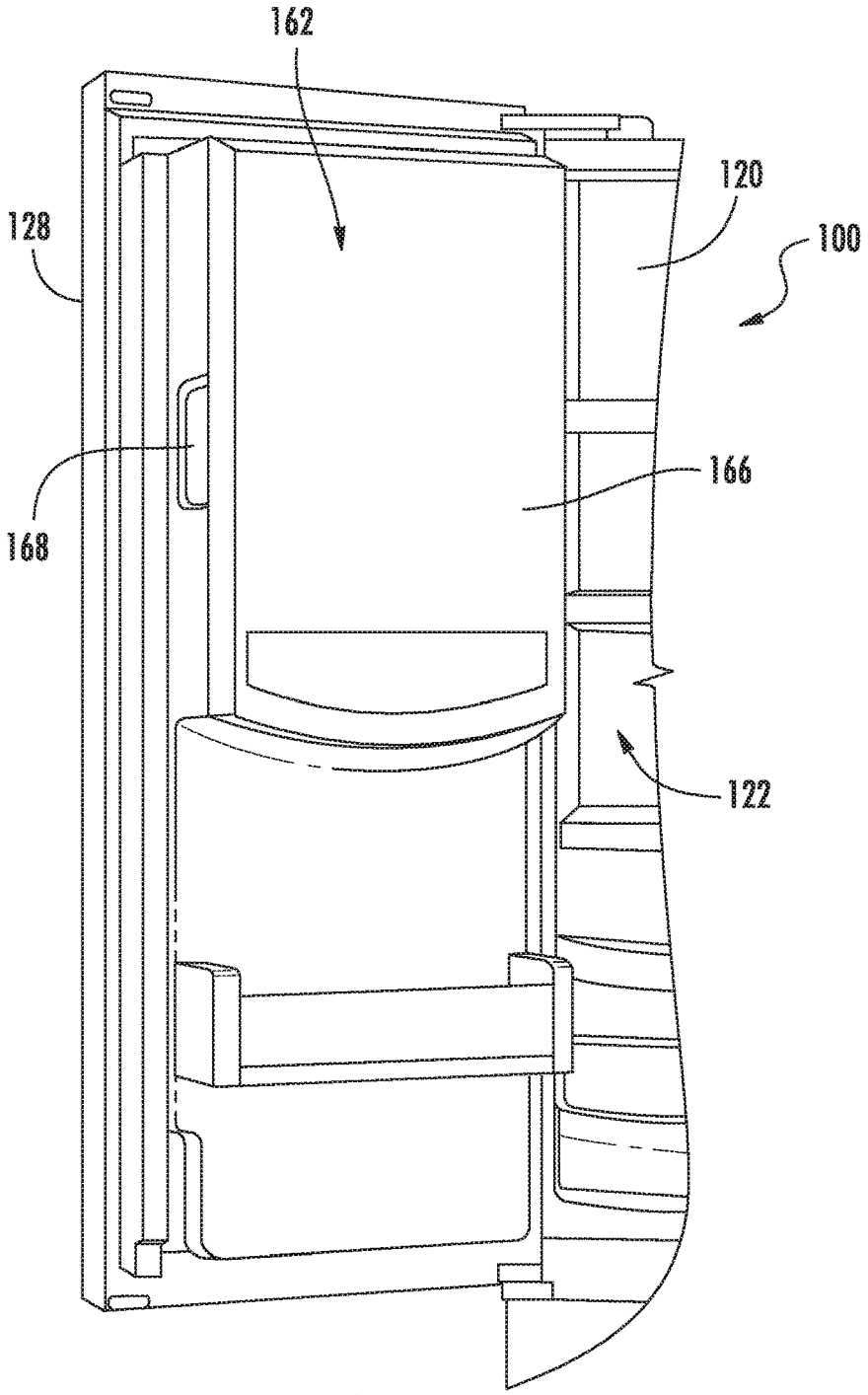
FIG. 2 provides a perspective view of a door of the exemplary refrigerator appliance of FIG. 1.

FIG. 2 provides a perspective view of a door of refrigerator doors 128. Refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. As discussed in greater detail below, an ice maker or ice making assembly 160 and an ice storage bin 164 (FIG. 3) are positioned or disposed within sub-compartment 162. Thus, ice is supplied to dispenser recess 150 (FIG. 1) from the ice making assembly 160 and/or ice storage bin 164 in sub-compartment 162 on a back side of refrigerator door 128. Chilled air from a sealed system (not shown) of refrigerator appliance 100 may be directed into components within sub-compartment 162, e.g., ice making assembly 160 and/or ice storage bin 164. In certain exemplary embodiments, a temperature air within sub-compartment 162 may correspond to a temperature of air within fresh food chamber 122, such that ice within ice storage bin 164 melts over time.

An access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162, e.g., by thermally isolating or insulating sub-compartment 162 from fresh food chamber 122.

Figure 3:
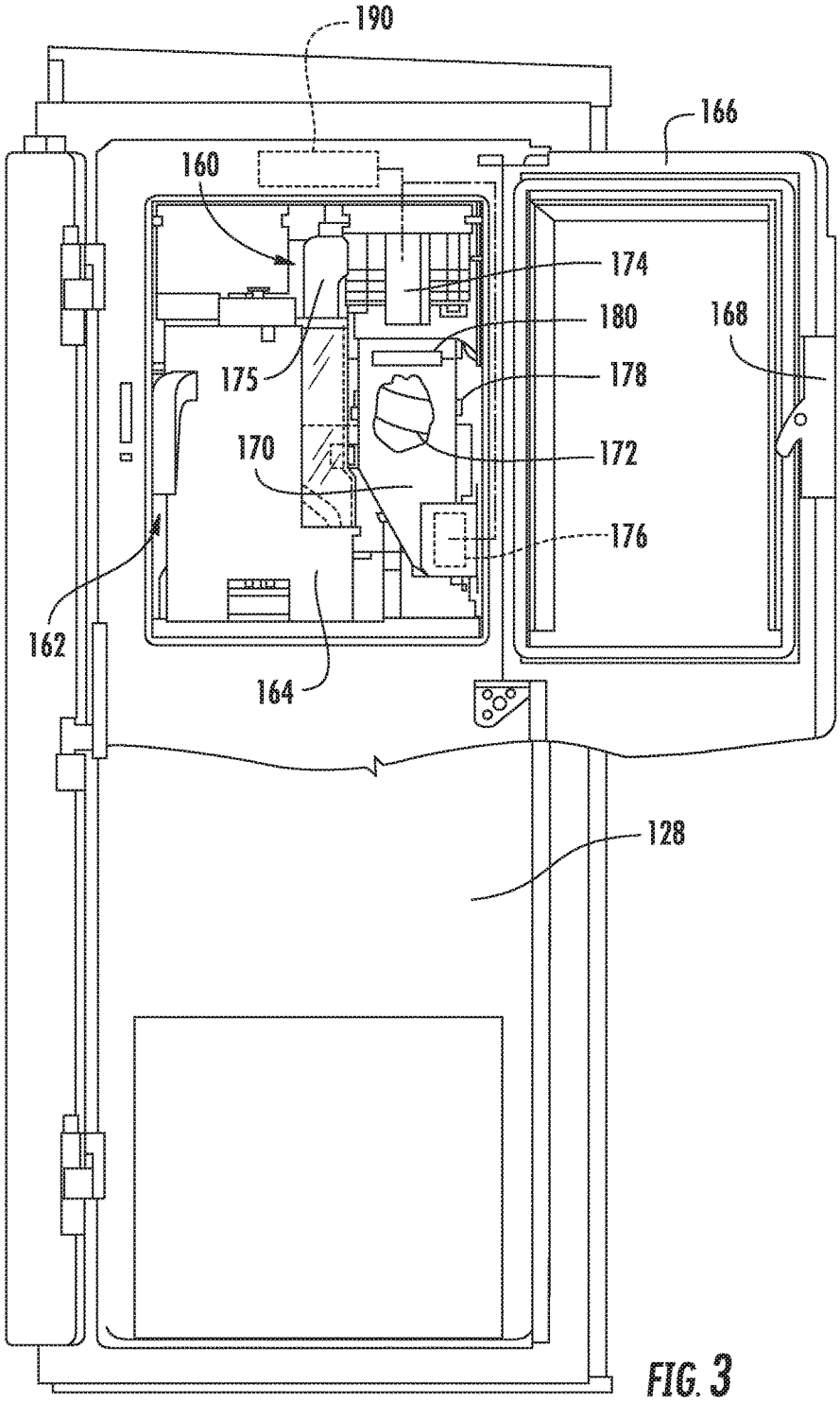
FIG. 3 provides an elevation view of the door of the exemplary refrigerator appliance of FIG. 2 with an access door of the door shown in an open position.

FIG. 3 provides an elevation view of refrigerator door 128 with access door 166 shown in an open position. As may be seen in FIG. 3, ice making assembly 160 is positioned or disposed within sub-compartment 162. Ice making assembly 160 includes a mold body or casing 170. An auger 172 is rotatably mounted in a mold body within casing 170 (shown partially cutout to reveal auger 172). In particular, a motor 174 is mounted to casing 170 and is in mechanical communication with (e.g., coupled to) auger 172. Motor 174 is configured for selectively rotating auger 172 in the mold body within casing 170. During rotation of auger 172 within the mold body, auger 172 scrapes or removes ice off an inner surface of the mold body within casing 170 and directs such ice to an extruder 175. At extruder 175, ice nuggets are formed from ice within casing 170. An ice bucket or ice storage bin 164 is positioned below extruder 175 and receives the ice nuggets from extruder 175. From ice storage bin 164, the ice nuggets can enter dispensing assembly 140 and be accessed by a user as discussed above. In such a manner, ice making assembly 160 can produce or generate ice nuggets.

Ice making assembly 160 also includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice making assembly 160 is air cooled in order to form ice therein. Ice making assembly 160 also includes a heater 180, such as an electric resistance heating element, mounted to casing 170. Heater 180 is configured for selectively heating casing 170, e.g., when ice prevents or hinders rotation of auger 172 within casing 170.

Operation of ice making assembly 160 is controlled by a processing device or controller 190, e.g., that may be operatively coupled to control panel 148 for user manipulation to select features and operations of ice making assembly 160. Controller 190 can operates various components of ice making assembly 160 to execute selected system cycles and features. For example, controller 190 is in operative communication with motor 174, fan 176 and heater 180. Thus, controller 190 can selectively activate and operate motor 174, fan 176 and heater 180.

Controller 190 may include a memory and microprocessor, such as a general or special purpose microprocessor operable to execute programming instructions or micro-control code associated with operation of ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 180 may be in communication with controller 190 via one or more signal lines or shared communication busses.

Ice making assembly 160 also includes a temperature sensor 178. Temperature sensor 178 is configured for measuring a temperature of casing 170 and/or liquids, such as liquid water, within casing 170. Temperature sensor 178 can be any suitable device for measuring the temperature of casing 170 and/or liquids therein. For example, temperature sensor 178 may be a thermistor or a thermocouple. Controller 190 can receive a signal, such as a voltage or a current, from temperature sensor 190 that corresponds to the temperature of the temperature of casing 170 and/or liquids therein. In such a manner, the temperature of casing 170 and/or liquids therein can be monitored and/or recorded with controller 190.

Figure 4:
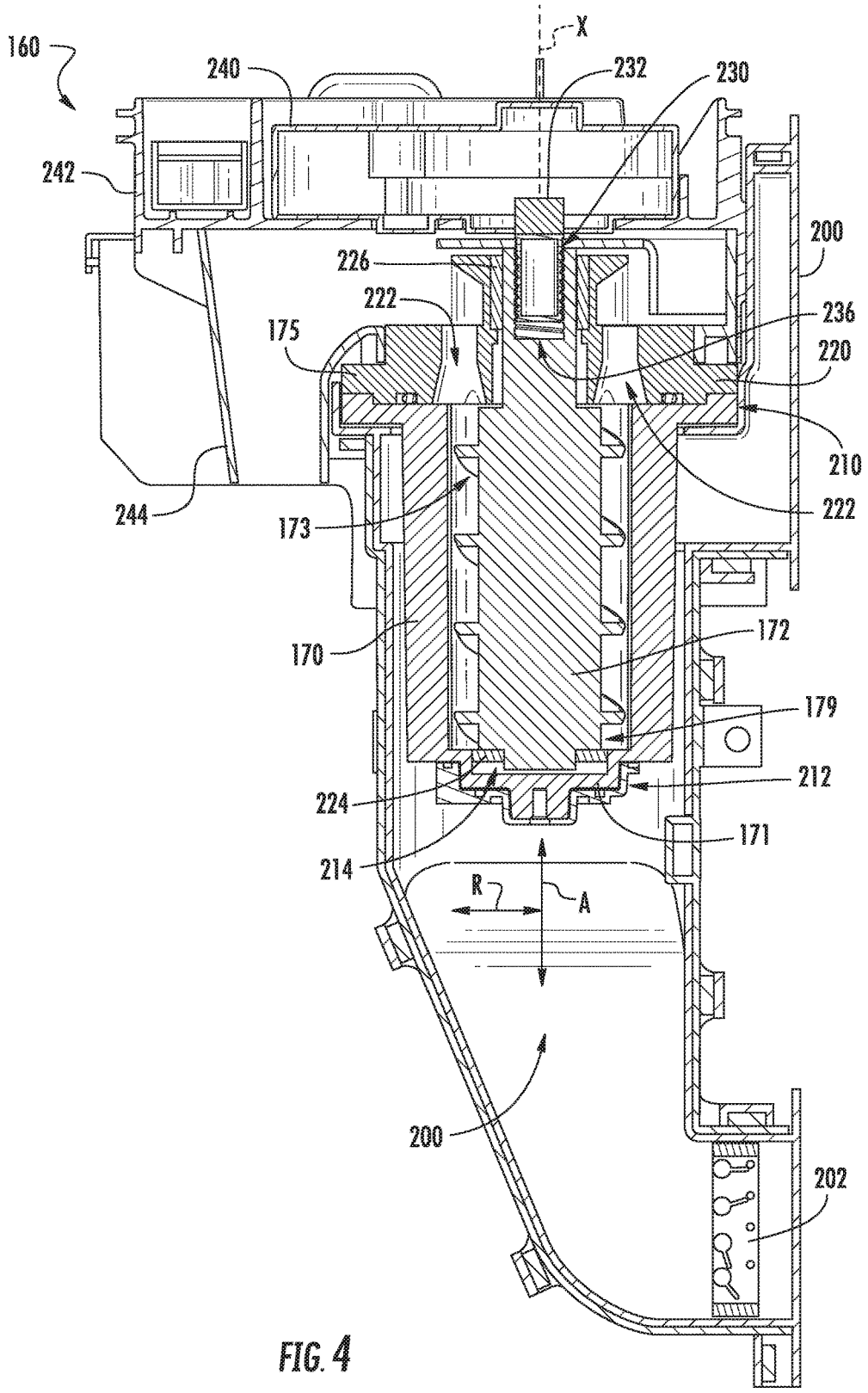
FIG. 4 provides a section view of an ice making assembly of the exemplary refrigerator appliance of FIG. 2.
Figure 5:
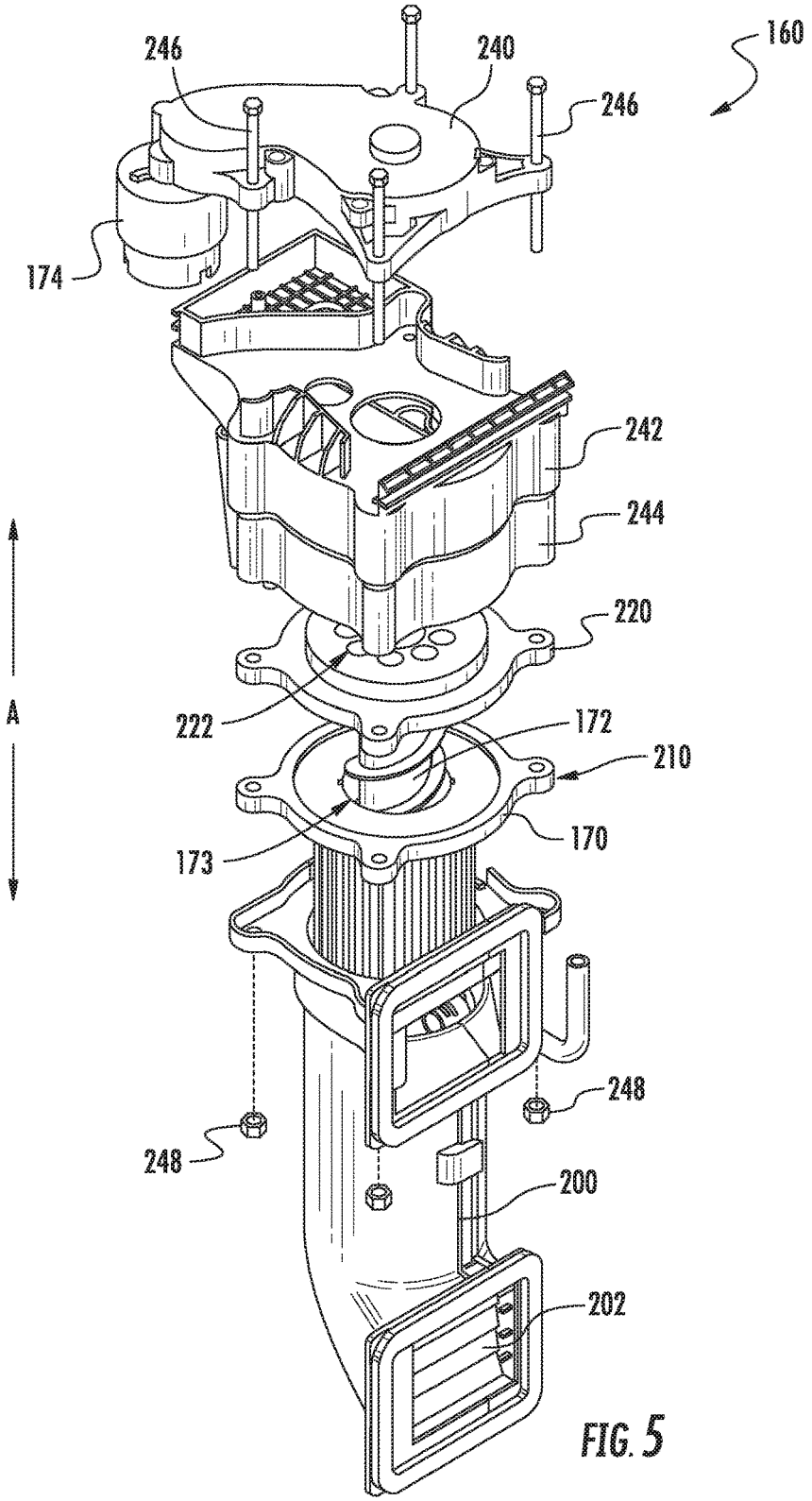
FIG. 5 provides an exploded view of the ice making assembly of FIG. 4.
Figure 6:
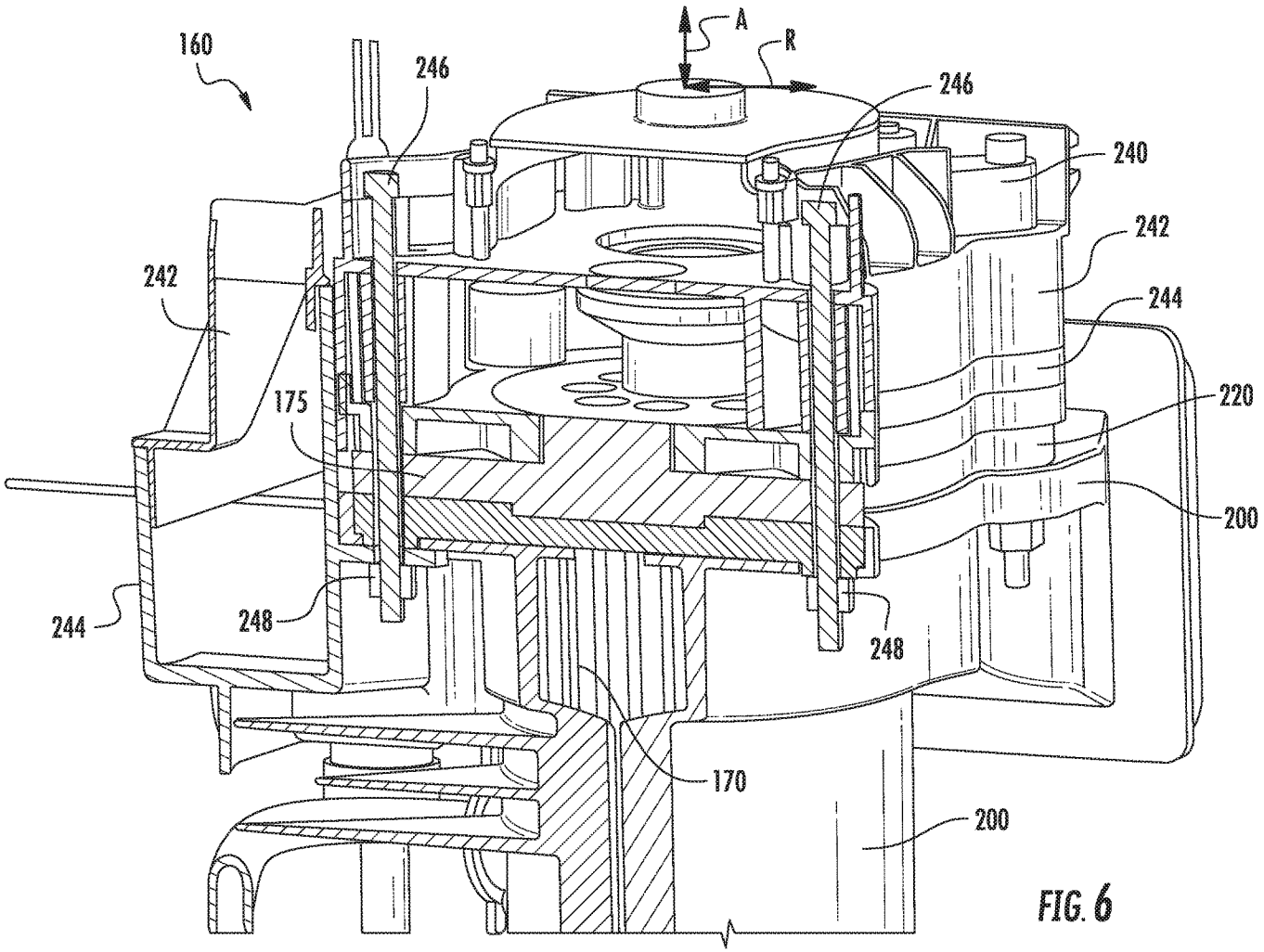
FIG. 6 provides partial section, view of the ice making assembly of FIG. 4.

FIG. 4 provides a section view of various components of ice making assembly 160, and FIG. 5 provides an exploded view of the various components ice making assembly 160. FIG. 6 provides partial section, view of ice making assembly 160. As may be seen in FIGS. 4, 5 and 6, ice making assembly 160 includes an air duct 200. Air duct 200 is configured for receiving a flow of chilled air, e.g., from freezer chamber 124, during operation of fan 176. Casing 170 is received within air duct 200. Thus, chilled air may flow around casing 170 within air duct 200 and cool casing 170 and water within casing 170 in order to form ice on an inner surface of casing 170. An adjustable baffle 202 within air duct 200 may assist with regulating the flow of chilled air through air duct 200.

Ice making assembly 160 also includes a motor housing 240, a shroud 242 and an ice chute 244. Air duct 200, motor housing 240, shroud 242 and ice chute 244 may be mounted together and collectively form an outer cover for interior components of ice making assembly 160, such as casing 170, the extruder, etc. Air duct 200, motor housing 240, shroud 242 and ice chute 244 may also be mounted to together in a manner that couples motor 174 (e.g., motor housing 240) to casing 170. For example, as shown in FIG. 6, bolts 246 may extend through casing 170, air duct 200, motor housing 240, shroud 242 and ice chute 244 along the axial direction A, and nuts 248 may be threaded onto bolts 246 in order to compress and mount casing 170, air duct 200, motor housing 240, shroud 242 and ice chute 244 together. Thus, casing 170, air duct 200, motor housing 240, shroud 242 and ice chute 244 may be sandwiched between heads of bolts 246 and nuts 248 along the axial direction A. In such a manner, casing 170, air duct 200, motor housing 240, shroud 242 and ice chute 244 may be fixed relative to one another.

Turning back to FIG. 4, as discussed above, ice making assembly 160 includes casing 170 and auger 172. During rotation of auger 172 within casing 170, auger 172 scrapes or removes ice off an inner surface of casing 170 and directs such ice to an extruder 175. Such action of auger 172 can generate a downward force on auger 172 and urges auger 172 towards a bottom wall 171 of casing 170. Ice making assembly 160 includes features for limiting or obstructing linear motion of auger 172 relative to casing 170, e.g., motion of auger 172 towards bottom wall 171 of casing 170. Such features are discussed in greater detail below.

As may be seen in FIG. 4, ice making assembly 160 includes a first radial sleeve bearing 224, a second radial sleeve bearing 226 and a threaded connection 230 between motor 174 and auger 172. First radial sleeve bearing 224, second radial sleeve bearing 226 and threaded connection 230 assist with regulating motion of auger 172 relative to casing 170, as discussed in greater detail below.

First radial sleeve bearing 224 and second radial sleeve bearing 226 may be positioned at or adjacent opposite ends of casing 170. For example, casing 170 extends between a top portion 210 and a bottom portion 212. First radial sleeve bearing 224 is positioned at and engages auger 172 at bottom portion 212 of casing 170. Conversely, second radial sleeve bearing 226 is positioned and engages auger 172 proximate, e.g., above, top portion 210 of casing 170. Thus, second radial sleeve bearing 226 may be positioned above first radial sleeve bearing 224, as shown in FIG. 4.

Auger 172 is rotatable on an axis of rotation X within chamber 173 of casing 170. First radial sleeve bearing 224 obstructs or limits movement of auger 172 relative to casing 170 along a direction perpendicular to the axis of rotation X, e.g., while allowing relatively free movement of auger 172 along the axis of rotation X. Thus, first radial sleeve bearing 224 may limit radial movement of a distal end portion 179 of auger 172 at or adjacent bottom portion 212 of casing 170. First radial sleeve bearing 224 may include an annular plastic, such as polytetrafluoroethylene (PTFE), bearing that extends circumferentially around auger 172 at distal end portion 179 of auger 172 and also extends along a radial direction R between casing 170 and auger 172 at distal end portion 179 of auger 172. In particular, first radial sleeve bearing 224 may be received within a bearing pocket 214 defined by casing 170 on bottom wall 171 of casing 170 (e.g., and that corresponds to a lowest portion of chamber 173 of casing 170). First radial sleeve bearing 224 may extend along the radial direction R between casing 170 and auger 172 within bearing pocket 214 on bottom wall 171 of casing 170. Radial sleeve bearing 200 may also assist with centering distal end portion 179 of auger 172 on the axis of rotation X at bottom portion 212 of casing 170. The axis of rotation X may be vertical or substantially (e.g., within ten degrees of) vertical in certain exemplary embodiments.

Second radial sleeve bearing 226 may be positioned at and engage auger 172 at an extruder die 220 that includes converging extruding openings 222. Extruder die 220 is mounted to casing 170 at or adjacent top portion 210 of casing 170. Extruder die 220 may function as a cover or seal for a chamber 173 defined by casing 170 in which auger 172 is disposed. Second radial sleeve bearing 226 may be received within and mounted to extruder die 220 above casing 170. Thus, second radial sleeve bearing 226 may be positioned above chamber 173 of casing 170 with extruder die 220 disposed between second radial sleeve bearing 226 and casing 170 along the axial direction A. In such a manner, contamination of water within chamber 173 of casing 170 from wear debris from second radial sleeve bearing 226 may be blocked or limited.

Second radial sleeve bearing 226 obstructs or limits movement of auger 172 relative to casing 170 along a direction perpendicular to the axis of rotation X, e.g., while allowing relatively free movement of auger 172 along the axis of rotation X. Thus, second radial sleeve bearing 226 may limit radial movement of auger 172 at or adjacent top portion 210 of casing 170. Second radial sleeve bearing 226 may include an annular plastic, such as polytetrafluoroethylene (PTFE), bearing that extends circumferentially around auger 172 and also extends along a radial direction R between auger 172 and extruder die 220, e.g., above chamber 173 of casing 170.

As may be seen in FIG. 5, motor 174 (e.g., a shaft 232 of motor 174) is positioned above extruder die 220. Motor 174 is also coupled to auger 172 at or above extruder die 220 along the axial direction. In particular, as discussed in greater detail below, shaft 232 of motor 174 may be threaded to auger 172 above at or above top portion 210 of casing 170.

Figure 7:
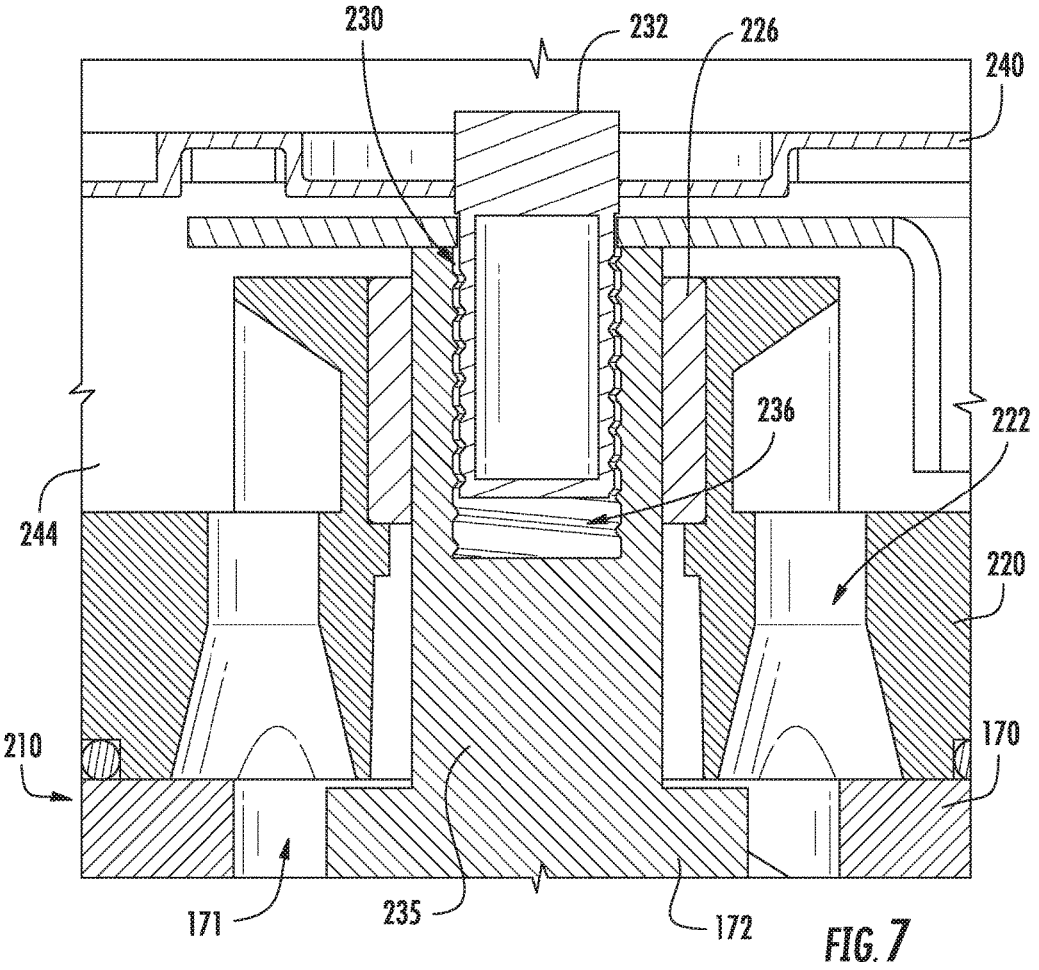
FIG. 7 provides a section view of a threaded connection between a shaft of a motor and an auger within the ice making assembly of FIG. 4.
Figure 8:
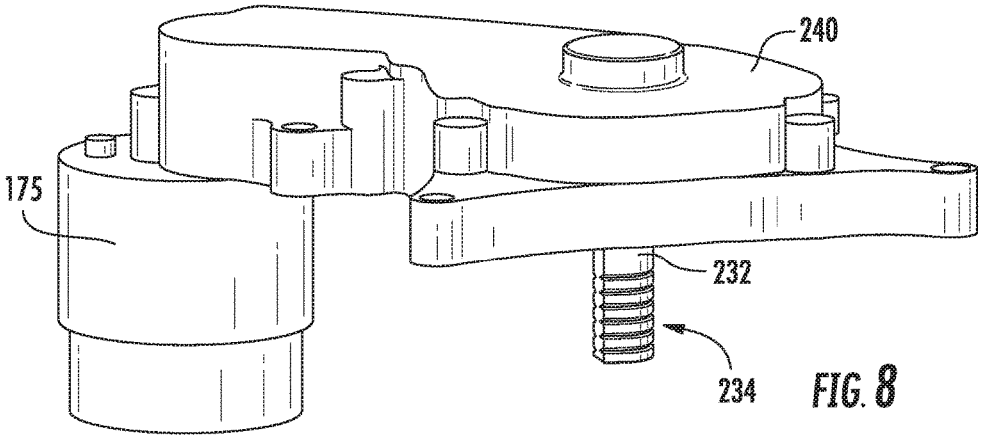
FIG. 8 provides a perspective view of the motor of the ice making assembly of FIG. 4.
Figure 9:
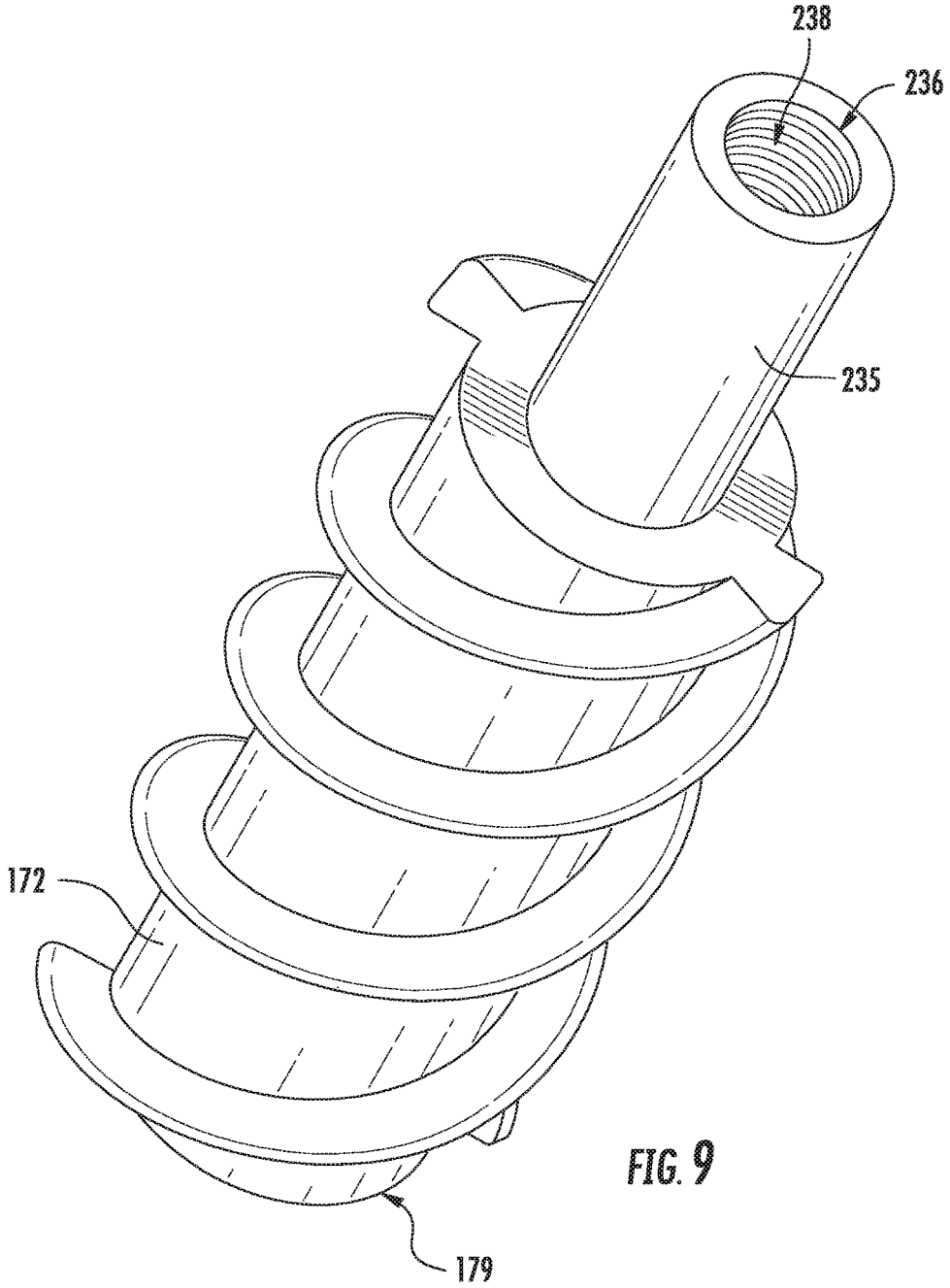
FIG. 9 provides a perspective view of the auger of the ice making assembly of FIG. 4.

FIG. 7 provides a section view of a threaded connection 230 between shaft 232 of motor 174 and auger 172. FIG. 8 provides a perspective view of motor 174, and FIG. 9 provides a perspective view of auger 172. Auger 172 is coupled to shaft 232 with a threaded connection 230. Thus, threaded connection 230 between shaft 232 and auger 172 permits motor 174 to rotate auger 172 along a rotational direction R within chamber 173 of casing 170 during operation of motor 174. The rotational direction R may be positive or negative, e.g., according to the right-hand rule, depending upon the twist of threads on auger 172.

Threaded connection 230 between auger 172 and shaft 232 may be configured to assist with limiting motion of auger 172 towards bottom wall 171 of casing 170 during operation of ice making assembly 160. In particular, threaded connection 230 between auger 172 and shaft 232 may be wound opposite the rotational direction R of auger 172. Thus, when motor 174 rotates auger 172 within casing 170, threaded connection 230 between auger 172 and shaft 232 draws auger 172 upwardly along the axial direction A away from bottom wall 171 of casing 170, e.g., due to the handedness of threaded connection 230 relative to the rotational direction R of auger 172.

As may be seen in FIG. 8, shaft 232 of motor 174 may define a male thread 234. Conversely, as shown in FIG. 9, auger 172 (e.g., a shaft 235 of auger 172 that extends from chamber 173 of casing 170 upwardly along the axial direction A) defines a socket 236 with a female thread 238. Shaft 232 may be disposed within socket 236 of auger 172 such that female thread 238 of socket 236 engages male thread 234 of shaft 232, as shown in FIG. 7. Thus, shaft 232 is threaded to auger 172 at socket 236. It should be understood that shaft 232 may define socket 236 with female thread 238 and auger 172 may define male thread 234, in alternative exemplary embodiments.

To assist with cinching auger 172 upwardly on shaft 232, male thread 234 of shaft 232 is wound opposite the rotational direction R of auger 172, e.g., such that threaded connection 230 between auger 172 and shaft 232 urges auger 172 away from bottom wall 171 of casing 170 along the axial direction A when motor 174 rotates auger 172 in the rotational direction R within casing 170. For example, male thread 234 of shaft 232 may have a right-hand twist when the rotational direction R of auger 172 is counterclockwise (e.g., when viewed from a driven end of auger 172, such as distal end portion 179 of auger 172). As another example, male thread 234 of shaft 232 may have a left-hand twist when the rotational direction R of auger 172 is clockwise (e.g., when viewed from the driven end of auger 172, such as distal end portion 179 of auger 172).

As shown in FIG. 4, bottom wall 171 of casing 170 is spaced apart from distal end portion 179 of auger 172 along the axial direction A by a gap G. By limiting downward motion of auger 172 along the axial direction A towards bottom wall 171 of casing 170, threaded connection 230 assists with maintaining the gap G between distal end portion 179 of auger 172 and bottom wall 171 of casing 170. In such a manner, rubbing or wear between auger 172 and casing 170 can be limited or avoided and performance of ice making assembly 160 can be improved.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker, comprising:

a casing defining a chamber, the casing extending between a top portion and a bottom portion;

an extruder die mounted to the casing at the top portion of the casing;

a motor positioned above the extruder die;

an auger disposed within the chamber of the casing, the auger coupled to a shaft of the motor with a threaded connection such that the auger is rotatable with the motor along a rotational direction within the chamber of the casing, the threaded connection between the auger and the shaft of the motor wound opposite the rotational direction of the auger; and a first radial sleeve bearing received within the casing, the first radial sleeve bearing engaging the auger at the bottom portion of the casing, the auger rotatable on an axis of rotation within the chamber of the casing, the first radial sleeve bearing obstructing movement of the auger relative to the casing along a direction perpendicular to the axis of rotation;

a second radial sleeve bearing engaging the auger at the extruder die, the second radial sleeve bearing obstructing movement of the auger relative to the extruder die along the direction perpendicular to the axis of rotation, wherein the auger extends along an axial direction from the threaded connection to a distal end portion of the auger, the distal end portion of the auger positioned within the chamber of the casing such that the distal end portion of the auger is spaced from the bottom wall of casing along the axial direction, the threaded connection between the auger and the shaft urging the distal end portion of the auger away from the bottom wall of the casing along the axial direction when the motor rotates the auger in the rotational direction, wherein the first radial sleeve bearing is received within a bearing pocket defined by the casing on the bottom wall of the casing, the first radial sleeve bearing engaging the distal end portion of the auger within the bearing pocket, and wherein the threaded connection and the second radial sleeve bearing are positioned within the extruder die, and the threaded connection is positioned within the second radial sleeve bearing.

2. The ice maker of claim 1, wherein the first radial sleeve bearing comprises an annular plastic bearing that extends between the casing and the auger at the bottom portion of the casing.

3. The ice maker of claim 1, wherein the second radial sleeve bearing comprises an annular plastic bearing that extends between the extruder die and the auger proximate the top portion of the casing.

4. The ice maker of claim 1, wherein the auger defines a socket with a female thread, the shaft of the motor defining a male thread, the shaft disposed within the socket of the auger such that the female thread of the socket engages the male thread of the shaft.

5. The ice maker of claim 4, wherein the male thread of the shaft is wound opposite the rotational direction of the auger such that the threaded connection between the auger and the shaft urges the auger away from a bottom wall of the casing when the motor rotates the auger in the rotational direction.

6. The ice maker of claim 5, wherein the male thread of the shaft has a right-hand twist and the rotational direction of the auger is counterclockwise.

7. The ice maker of claim 5, wherein the male thread of the shaft has a left-hand twist and the rotational direction of the auger is clockwise.

8. A refrigerator appliance comprising:

a housing defining a chilled chamber;

an ice maker disposed within the housing, the ice maker comprising a casing defining a chamber, the casing extending between a top portion and a bottom portion;

an extruder die mounted to the casing at the top portion of the casing;

a motor positioned above the extruder die;

an auger disposed within the chamber of the casing, the auger coupled to a shaft of the motor with a threaded connection such that the auger is rotatable with the motor along a rotational direction within the chamber of the casing, the threaded connection between the auger and the shaft of the motor wound opposite the rotational direction of the auger; and a first radial sleeve bearing received within the casing, the first radial sleeve bearing engaging the auger at the bottom portion of the casing, the auger rotatable on an axis of rotation within the chamber of the casing, the first radial sleeve bearing obstructing movement of the auger relative to the casing along a direction perpendicular to the axis of rotation;

a second radial sleeve bearing engaging the auger at the extruder die, the second radial sleeve bearing obstructing movement of the auger relative to the extruder die along the direction perpendicular to the axis of rotation, wherein the auger extends along an axial direction from the threaded connection to a distal end portion of the auger, the distal end portion of the auger positioned within the chamber of the casing such that the distal end portion of the auger is spaced from the bottom wall of casing along the axial direction, the threaded connection between the auger and the shaft urging the distal end portion of the auger away from the bottom wall of the casing along the axial direction when the motor rotates the auger in the rotational direction, wherein the first radial sleeve bearing is received within a bearing pocket defined by the casing on the bottom wall of the casing, the first radial sleeve bearing engaging the distal end portion of the auger within the bearing pocket, and wherein the threaded connection and the second radial sleeve bearing are positioned within the extruder die, and the threaded connection is positioned within the second radial sleeve bearing.

9. The refrigerator appliance of claim 8, wherein the first radial sleeve bearing comprises an annular plastic bearing that extends between the casing and the auger at the bottom portion of the casing.

10. The refrigerator appliance of claim 8, wherein the second radial sleeve bearing comprises an annular plastic bearing that extends between the extruder die and the auger proximate the top portion of the casing.

11. The refrigerator appliance of claim 8, wherein the auger defines a socket with a female thread, the shaft of the motor defining a male thread, the shaft disposed within the socket of the auger such that the female thread of the socket engages the male thread of the shaft.

12. The refrigerator appliance of claim 11, wherein the male thread of the shaft is wound opposite the rotational direction of the auger such that the threaded connection between the auger and the shaft urges the auger away from a bottom wall of the casing when the motor rotates the auger in the rotational direction.

13. The refrigerator appliance of claim 12, wherein the male thread of the shaft has a right-hand twist and the rotational direction of the auger is counterclockwise.

14. The refrigerator appliance of claim 12, wherein the male thread of the shaft has a left-hand twist and the rotational direction of the auger is clockwise.

* * * * *